US006142759A

United States Patent [19]

Tateno et al.

[11] Patent Number: 6,142,759

[45] Date of Patent: Nov. 7, 2000

[54] TWO-SHIFT FLUID MACHINE

[75] Inventors: Masao Tateno; Kenji Hiraishi, both of Tochigi, Japan

[73] Assignee: Tochigi Fuji Sangyo Kabushiki, Tochigi-ken, Japan

[21] Appl. No.: 09/040,602

[22] Filed: Mar. 18, 1998

[30] Foreign Application Priority Data

Mar. 21, 1997 [JP] Japan ..... 9-068449

[51] Int. Cl.[7] ..... F04C 18/00

[52] U.S. Cl. ..... 418/206.5; 418/206.1; 418/189; 418/180; 418/191

[58] Field of Search ..... 418/206.5, 206.1, 418/180, 189, 191

[56] References Cited

U.S. PATENT DOCUMENTS

| | | | |
|---|---|---|---|
| 2,853,766 | 9/1958 | Wellington et al. . | |
| 2,857,779 | 10/1958 | Frei et al. . | |
| 3,275,225 | 9/1966 | Schultz | 418/206.1 |
| 3,612,733 | 10/1971 | Wilcox | 418/189 |
| 4,390,331 | 6/1983 | Nachtrieb . | |
| 4,511,316 | 4/1985 | Ellis . | |
| 4,594,992 | 6/1986 | Nakamura et al. | 418/180 |
| 4,595,349 | 6/1986 | Preston | 418/206.1 |
| 4,666,384 | 5/1987 | Kaga et al. | 418/206.1 |
| 4,813,857 | 3/1989 | Kawakami | 418/206.1 |
| 4,971,536 | 11/1990 | Takeda et al. | 418/206.1 |
| 4,974,318 | 12/1990 | Heppekausen et al. . | |
| 5,312,236 | 5/1994 | Kishimoto | 418/206.1 |
| 5,797,735 | 8/1998 | Ishikawa et al. | 418/206.1 |
| 5,938,420 | 8/1999 | Teraoka | 418/206.1 |

FOREIGN PATENT DOCUMENTS

| | | | |
|---|---|---|---|
| 220279 | 3/1962 | Austria | 418/206.1 |
| 205103 | 12/1986 | European Pat. Off. | 418/206.1 |
| 0637691 | 2/1995 | European Pat. Off. . | |
| 2578588 | 9/1986 | France | 418/206.1 |
| 693372 | 7/1940 | Germany . | |
| 882746 | 7/1953 | Germany . | |
| 2409554 | 9/1975 | Germany . | |
| 63390 | 4/1984 | Japan | 418/206.1 |
| 260-240891 | 11/1986 | Japan | 418/206.1 |
| 0310122 | 12/1989 | Japan | 418/206.1 |
| 40616286 | 6/1994 | Japan | 418/206.1 |
| 406-229385 | 8/1994 | Japan | 418/206.1 |
| 556701 | 10/1943 | United Kingdom . | |
| 644957 | 11/1950 | United Kingdom | 418/206.1 |
| 2033475 | 5/1980 | United Kingdom . | |
| 2 118 628 | 11/1983 | United Kingdom | 418/206.1 |
| 2141486 | 12/1984 | United Kingdom . | |
| WO 93/14314 | 7/1993 | WIPO . | |

*Primary Examiner*—Thomas Denion
*Assistant Examiner*—Thai-Ba Trieu
*Attorney, Agent, or Firm*—Morrison & Foerster

[57] ABSTRACT

In a Roots displacement fluid machine (5) comprising rotors (15, 17) meshed with each other in a tooth trace (57, 59) formed in parallel to a rotating central axis, and a casing (13) having a rotor chamber (33) rotatably receiving the rotors (15, 17), a fluid inlet port for a fluid and a fluid outlet port, an inclined surface (67) forming an angle θ with respect to an opposing surface (65) of the rotor chamber (33) is disposed at least in a tip end of the end portion of the rotor (15), and a gap (69) is formed with respect to the opposing surface (65).

4 Claims, 4 Drawing Sheets

TWO-SHIFT FLUID MACHINE

BACKGROUND OF THE INVENTION

1. Field of the Invention

The present invention relates to a two-shaft fluid machine, for example, used for a fun and a compressor, specifically for a supercharger of a vehicle.

2. Description of the Related Art

A Roots displacement mechanical supercharger 201 for the conventional two-shaft fluid machine as shown in FIG. 1 is described in Japanese Patent Application Laid-Open No. 6-12987.

The Roots displacement mechanical supercharger 201 is constituted by a pair of rotors 203 and 205 meshed with each other in a tooth trace in parallel to a rotating central axis, a casing 209 for rotatably receiving them in a rotor chamber 207, a set of timing gears 211 synchronously rotating each of the rotors 203 and 205 and making them meshed in such a manner as not to be in contact with each other, an input pulley 213 and the like.

The input pulley 213 is fixed to a rotor shaft 215 of the input end rotor 203, and is connected to the engine end pulley through a belt. When the rotors 203 and 205 are rotated, an intake air is sucked to the rotor chamber 207 from a fluid inlet port of the casing 209, and is discharged from a fluid outlet port so as to be fed to the suction end of the engine.

In the Roots displacement mechanical supercharger 201, in order to prevent each of the rotors 203 and 205 from being brought into contact with each other, it is necessary to provide a suitable gap between them, and further it is desirable to make the gap as narrow as possible so as to miniaturize an air leakage.

Then, in a conventional art, a thick coating having a general thickness of about 0.4 mm is given on all the surface of each of the rotors 203 and 205, and each of the rotors 203 and 205 is rotated and fitted, thereby cutting down the contact coating with each other, so that a treatment for forming a suitable gap is performed.

However, since the coating of the rotor is expensive, it is desirable to reduce the cost by making the coating thin, however, when the coating is made thin, there occurs an exposure of a surface of the rotor due to a slight contact, and there is a fear that a seizure and sticking is generated.

A certain degree of gap is provided between tips of the respective rotors 203 and 205, and between the tips of the respective rotors 203 and 205 and the rotor chamber 207 in order to prevent contact as mentioned above, however, since the pga between the tips of the rotors 203 and 205 and the rotor chamber 207 is set to be narrow, a problem of peeling of the coating easily occurs at an end surface of the rotors 203 and 205.

Further, a tensile force of the belt applied to the input end rotor 203 through the input pulley 213 is given to the bearing 217 and 219 supporting the rotor shaft 215, the rotor 203 is inclined by a fine gap disposed between the internal and external races of the bearing and the rolling element, and a thermal expansion of the casing 209 is added, so that the end surface of the rotor 203 and the rotor chamber 207 are brought into contact with each other and the coating is easily peeled.

Still further, in the Roots displacement mechanical supercharger 201 described above, since the length (radius of the rotor) between the central axis of the rotor and the outer peripheral portion of the rotor is grate relating to the other length between the bearings supporting the rotor, the contact between the rotor end portion of the rotor and the opposing surface of the rotor chamber can be occurred when the rotor is inclined.

SUMMARY OF THE INVENTION

The present invention has been achieved with such points in mind.

It therefore is an object of the present invention to provide a two-shaft fluid machine which prevents an end surface of a rotor and a rotor chamber from being in contact with each other and generating a seizure and sticking.

In accordance with a first aspect of the invention, there is provided a Two-shaft fluid machine comprising: a pair of rotors meshed with each other in a tooth trace formed at an outer peripheral end of a rotating central axis; and a casing having a rotor chamber rotatably receiving each of the rotors, a fluid inlet port for a fluid and a fluid outlet port, wherein an inclined surface forming an angle θ with respect to an opposing surface of the rotor chamber is disposed at least in a tip end of the rotor end portion, thereby forming a gap with respect to the opposing surface.

As mentioned above, in accordance with the Two-shaft fluid machine stated in the first aspect, the gap is provided with respect to the opposing surface by forming the inclined surface (the angle θ) with respect to the opposing surface of the rotor chamber at least in the tip end of the rotor end portion.

Accordingly, even when the rotor is inclined and the casing is thermally expanded, the end surface of the rotor and the rotor chamber are prevented from being brought into contact with each other due to the gap, and the peeling of the coating and seizure (sticking) of the exposed surface of the rotor can be prevented.

Here, in the case of the Two-shaft fluid machine, the gap between the end surface of the rotor and the rotor chamber is not largely affected to an efficiency.

Since the peeling of the coating is prevented in the manner mentioned above, the thickness of the coating can be made thin to a minimum extent, so that the cost thereof can be largely reduced.

Further, since the contact with the rotor is prevented till being brought into contact with the rotor chamber, an inclination of the rotor shaft can be allowed at a certain degree. Accordingly, even when the rotor shaft is inclined, no influence is given to the function. As mentioned above, since the inclination of the rotor shaft can be allowed at a certain degree, a durability is advantageously made long at that degree.

In accordance with a second aspect of the invention, as it depends from the first aspect, the inclined surface having an angle θ is formed on all the surface of the rotor end portion.

In addition, since the inclined surface having an angle θ is formed on all the surface of the rotor end portion, even when the rotor is greatly inclined, or even when the thermal expansion of the casing is larger, an effect of preventing the rotor end portion and the rotor chamber from being brought into contact with each other can be obtained.

In accordance with a third aspect of the invention, as it depends from the first aspect, the rotor is formed with a plane surface opposing to the inner surface of the rotor chamber at the center portion of the rotor end portion; and the rotor is formed with a inclined surface having an angle θ at the outer portion of the rotor end portion.

In accordance with the Two-shaft fluid machine stated in the third aspect, since the plane surfaces of the both ends of the rotor can define the whole length of the rotor, the clearance between the inner surface of the rotor chamber and the rotor end portion of the rotor can be settled appropriately.

In accordance with a fourth aspect of the invention, as it depends from the first aspect, the two-shaft fluid machine is further comprises: a transmission mechanism for transmitting a rotation drive force to the rotor in the input end is provided, wherein the angle θ of the inclined surface is determined in accordance with an inclination of the rotor, the inclination is generated by the force received from the transmission mechanism.

In addition, for example, as a belt tensional force of a belt transmission mechanism, since the angle θ of the inclined surface is determined in accordance with the inclination of the rotor generated by the force received from the transmission mechanism, the contact with respect to the rotor chamber and the peeling of the coating can be effectively prevented by making the angle θ large in the case that the large force is applied, and by making the angle θ small in the case that the small force is applied, so that a maximum effect of preventing the contact can be obtained by the minimum angle θ.

In accordance with a fifth aspect of the invention, as it depends from the first aspect, the two-shaft fluid machine is a roots displacement fluid machine of which the pair of rotors meshes with each other in the tooth traces formed in parallel to a rotating central axis of the rotors.

In accordance with the Two-shaft fluid machine stated in the fifth aspect, even the length (radius of the rotor)between the central axis of the rotor and the outer peripheral portion of the rotor is grate relating to the other length between the bearings supporting the rotor, the contact between the rotor end portion of the rotor and the opposing surface of the rotor chamber can be prevented when the rotor is inclined.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
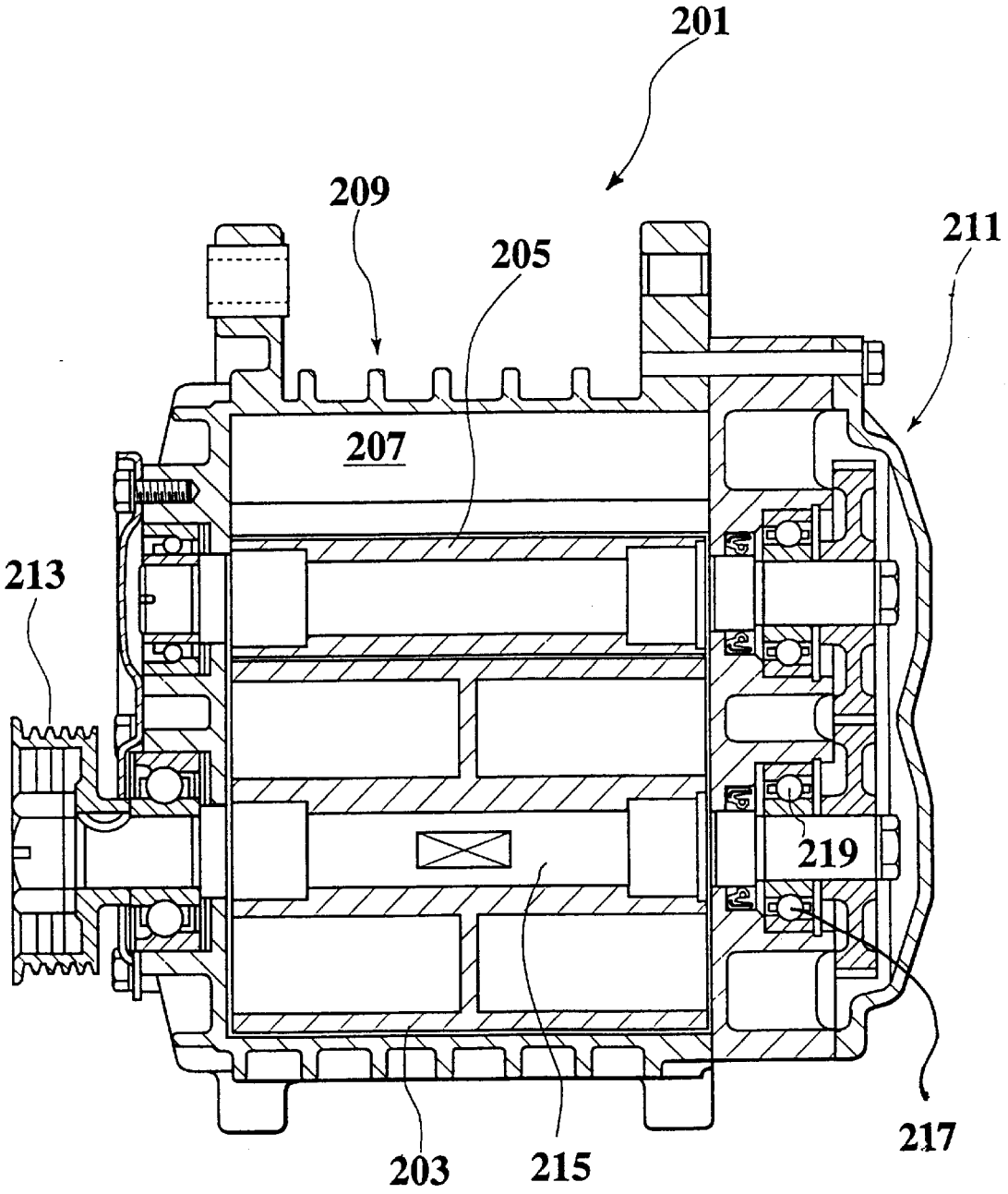
FIG.1 PRIOR ART
FIG. 1 is a cross sectional view of a conventional fluid machine.

There will be detailed below the preferred embodiments of the present invention with reference to the accompanying drawings. Like members are designated by like reference characters.

Figure 2:
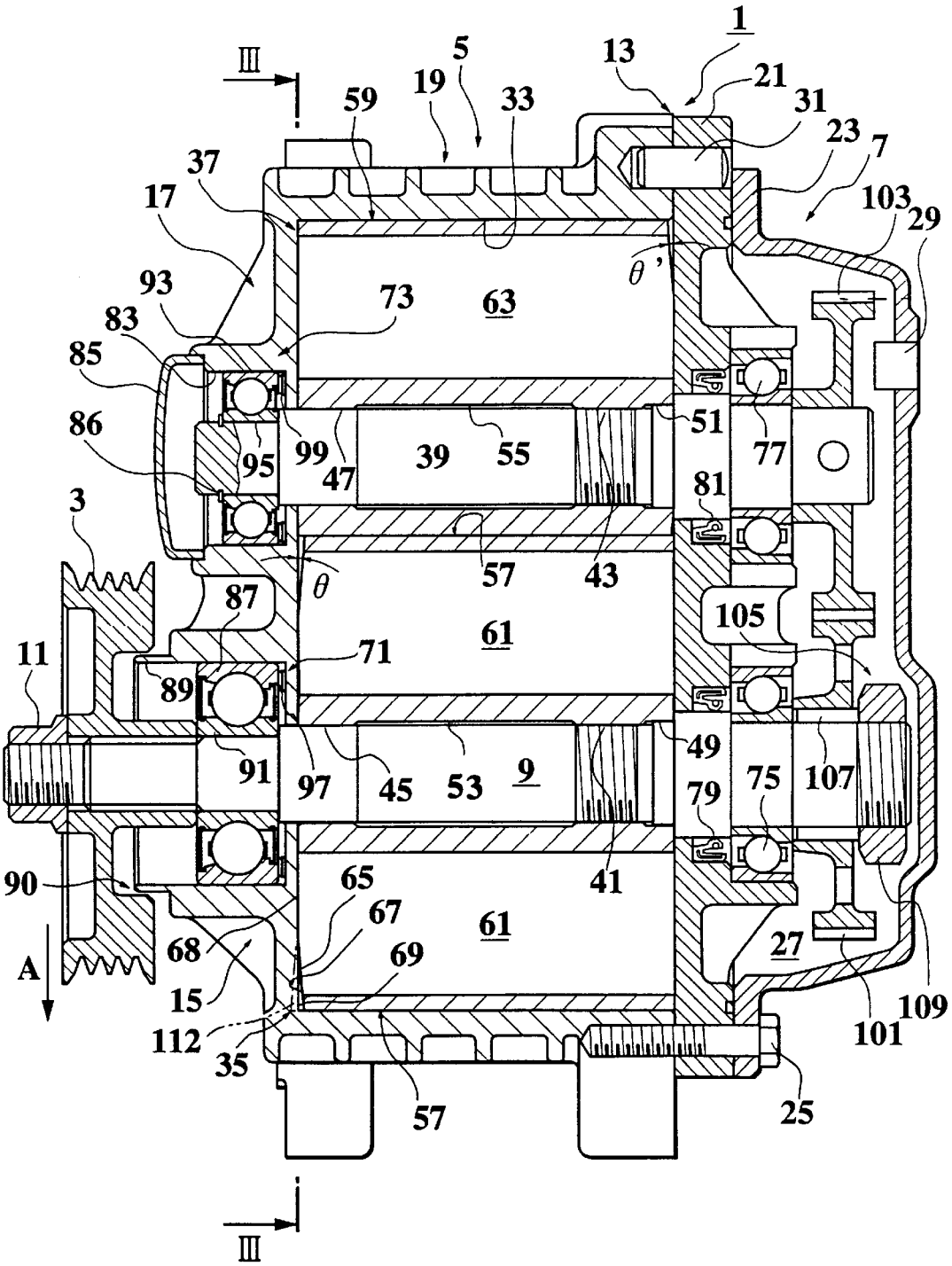
FIG. 2 is a cross sectional view which shows an embodiment in accordance with the present invention.

An embodiment in accordance with the present invention will be described below with reference to FIGS. 2 and 3. The embodiment is provided with features of the aspects. FIG. 2 shows a supercharger 1 in accordance with the embodiment. Further, a lateral direction corresponds to a lateral direction in FIGS. 2 and 3, and elements to which no reference symbol is applied are not illustrated.

The supercharger 1 as two-shaft fluid machine is constituted by an input pulley 3, a Roots displacement compressor 5 (a two-shaft fluid machine), a set of timing gears 7 and the like.

The input pulley 3 is connected to a rotor shaft 9 in the input end by a spline, and is fixed thereto by a nut 11. The input pulley 3 is connected to a pulley in a crank shaft end through a belt. An electromagnetic clutch is assembled to the crank shaft end pulley, thereby connecting and disconnecting an engine (prime mover) to the supercharger 1.

As mentioned above, the input pulley 3 is rotated by a drive force of the engine through the electromagnetic clutch and the belt transmission mechanism (a transmission mechanism).

The compressor 5 is provided with a compressor casing 13 (a casing), rotors 15 and 17 and the like.

The compressor casing 13 is structured by fixing covers 21 and 23 to a right side of a casing body 19 by means of a bolt 25, and the set of timing gears 7 are received in an oil chamber 27 formed between the cover 21 and the cover 23. An oil is filled in the oil chamber 27 from an oil filler 29 of the cover 23, and an oil reservoir is provided.

The casing body 19 and the cover 21 are positioned by a pin 31.

The compressor casing 13 is provided with a rotor chamber 33 rotatably receiving each of the rotors 15 and 17, a suction port (a fluid inlet port) 16 for an engine intake air and a discharge port (a fluid outlet port) 18.

One rotor 15 is constituted by a rotor body 35 and the input end rotor shaft 9, and the other rotor 17 is constituted by a rotor body 37 and a rotor shaft 39.

The respective rotor shafts 9 and 39 and the respective rotor bodies 35 and 37 are press fitted to each other in pressing portions 45 and 47 each having a small diameter and pressing portions 49 and 51 each having a large diameter by rotating screw portions 41 and 43 between them. Further, gaps 53 and 55 are formed between the respective rotor shafts 9 and 39 and the respective rotor bodies 35 and 37.

Tooth traces 57 and 59 are formed in the respective rotor bodies 35 and 37 in such a manner as to be in parallel to a rotating center axis of the rotors 15 and 17. Hollow portions 61 and 63 are formed on the respective tooth trace 57 and 59, thereby reducing a moment of inertia in the rotors 15 and 17, and improving a response of the supercharger 1 at a time of acceleration or the like.

Further, a coating is given on the surface of the respective rotor bodies 35 and 37, thereby adjusting a gap between the respective tooth traces 57 and 59 and the rotor chamber 33 to a predetermined value by fitting in the above manner. A thickness of the coating is made thinner than a thickness of 0.4 mm in accordance with the conventional embodiment.

As shown in FIG. 2, an inclined surface 67 forming the slightly small angle θ with respect to an opposing surface 65 of the rotor chamber 33 is formed on the left end portion of the rotor 35 in the rotor 15, and a gap 69 is formed with respect to the opposing surface 65 by the inclined surface 67.

In addition to the inclined forming, the rotor body 35 is formed with a plane surface 68 opposing to the opposing surface 65 of the rotor chamber 33 at the center portion of the rotor end portion, namely at inner portion of the inclined surface 67. Therefore, when the rotor body 35 is machine-worked, the whole length of the rotor between the plane surface 68 and the other end surface of the rotor body 35 can define, thereby the clearance and gap 69 between the opposing surface 65 of the rotor chamber 33 and the inclined surface 67 of the rotor body 35 can be settled appropriately.

Here, in the case of the Roots displacement fluid machine such as the compressor 5, the gap between the end surface of the rotors 15 and 17 and the rotor chamber 33 gives an influence to an efficiency in a significantly less manner in comparison with the gap between the tooth traces of the rotors 15 and 17 and between the tooth traces of the rotors 15 and 17 and the rotor chamber 33.

Each of the rotor shafts 9 and 39 is supported to the compressor casing 13 in the left side of the rotor bodies 35 and 37 by sealing type ball bearings 71 and 73, and is supported to the compressor casing 13 in the right side of the rotor bodies 35 and 37 by angular contact type ball bearings 75 and 77.

Seals 79 and 81 are disposed between the rotor shafts 9 and 39 and the compressor casing 13 in the left side of the angular contact bearings 75 and 77. Further, an opening portion of a bearing housing 83 in the seal bearing 73 is closed by a cover 85, and the seal bearing 71 prevents dusts from entering by means of an uneven step portion 90 formed between the casing 13 and the pulley 3.

An air leakage from the rotor chamber 33 to an outer portion is prevented by the seal bearings 71 and 73 and the seals 79 and 81, an oil leakage from the oil chamber 27 end to the rotor chamber 33 is prevented by the seals 79 and 81.

Further, an outer race 87 of the seal bearing 71 is lightly press fitted to a bearing housing 89, and an inner race 91 is firmly press fitted to the rotor shaft 9, so that a positioning in an axial direction is performed by screwing the nut 11 through the pulley 3. In the same manner, in the seal bearing 73, an outer race 93 is lightly press fitted to the bearing housing 83, and an inner race 95 is firmly press fitted to the rotor shaft 39, so that a positioning in an axial direction is performed by a snap ring 86.

Springs 99 and 97 are disposed in the bearing housings 83 and 89, respectively. The respective springs 97 and 99 press the seal bearings 71 and 73 and the rotor shafts 9 and 39 leftward by slightly moving the respective outer races 87 and 93 leftward. In the respective seal bearings 71 and 73 and the respective angular contact bearings 75 and 77, a gap (a play) in a diametrical direction is adjusted to a minimum value by receiving the pressing force.

The set of timing gears 7 are constituted by a pair of timing gears 101 and 103 meshed with each other, and the timing gear 101 is fixed to the right end of the rotor shaft 9 by a taper ring fixing mechanism 105. Further, the timing gear 103 is press fitted to the right end portion of the rotor shaft 39.

The taper ring fixing mechanism 105 is constituted by a taper ring 107 and a nut 109 meshed with the right end of the rotor shaft 9, and positions the timing gear 101 in a rotating direction by pressing the taper ring 107 to a portion between the timing gear 101 and the rotor shaft 9 by means of a nut 109.

Positioning of the respective timing gears 101 and 103 to a rotating direction is performed by meshing the tooth traces 57 and 59 of the respective rotors 15 and 17 with each other, in a state of making a gap in a rotating direction and an opposing direction formed between the tooth traces 57 and 59 uniform, meshing the timing gears 101 and 103 with each other, and positioning the timing gear 101 and the rotor shaft 9 to a rotating direction by the taper ring fixing mechanism 105.

A drive force of the engine input from the pulley 3 drives the compressor 5, and the set of timing gears 7 synchronously rotate the rotors 15 and 17 in such a manner as not to be in contact with each other. When the rotors 15 and 17 rotate, the compressor 5 sucks an intake air from the suction port 16 of the compressor casing 13 and discharges from the discharge port 18, thereby supplying to the engine.

A tension of the belt is applied to the rotor shaft 9 of the input end rotor 15 through the pulley 3 in one direction as shown in an arrow A of FIG. 2, and there is a case that the rotor 15 (the rotor shaft 9) is inclined due to the gap between the inner and outer races of the bearings 71 and 75 and the ball as a rolling element. Further, a thermal expansion is generated in the compressor casing 13 (the rotor chamber 33).

However, as mentioned above, since the gap 69 is formed with respect to the opposing surface 65 of the rotor chamber 33 by the inclined surface 67 provided in the left end portion of the input end rotor 15, even when the rotor 15 is inclined, or even when the rotor chamber 33 is thermally expanded, the left end portion of the rotor 15 and the opposing surface 65 are not brought into contact with each other.

Accordingly, in the rotor 15, the coating is prevented from being peeled, and the seizure and sticking with respect to the rotor chamber 33 is also prevented.

An angle θ of the inclined surface 67 is determined in accordance with an inclined angle of the rotor 15 due to the belt tension.

In this case, a meshing reaction force from the timing gear which is vertically applied to the rotor shaft 39 and a contact due to a thermal expansion may be avoided by giving an inclined angle of θ' to the end surface of the rotor 17 in the same manner as that of the rotor 15.

As in a manner mentioned above, the supercharger 1 is constructed.

Since the supercharger 1 prevents the contact with the rotor chamber 33 by the inclined surface 67 provided in the left end portion of the rotor 15, as mentioned above, and prevents the peeling and seizure and sticking of the coating, the thickness of the coating can be made thin to a minimum extent, for example, the thickness of about 0.1 mm which is about a quarter the conventional one is sufficient, so that the cost can be reduced at that degree.

Further, since an inclination of the rotor shaft 9 is allowed at a certain degree by preventing the left end portion of the rotor 15 and the rotor chamber 33 from being brought into contact with each other, and this does not give any influence to an efficiency, a durability of the compressor 5 can be advantageously improved at that degree.

Furthermore, since the angle θ of the inclined surface 67 is determined in accordance with the inclination of the rotor 15 generated by the belt tension, the contact with the rotor chamber 33 and the peeling of the coating can be effectively prevented with the minimum angle θ by making the angle θ large when the belt tension is large, and by making the angle θ small when the belt tension is small.

Figure 4:
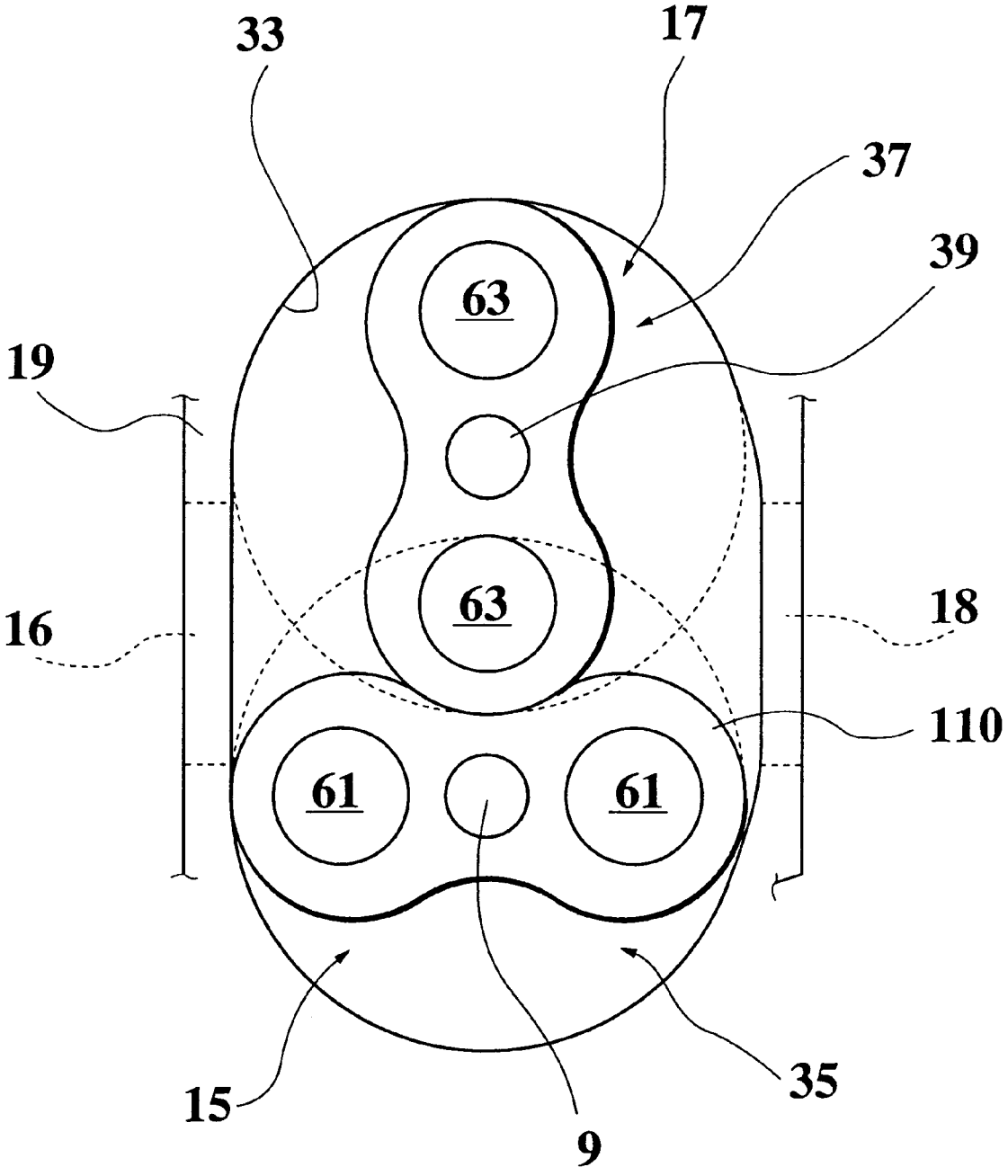
FIG. 4 is a side elevational view of a rotor in accordance with the second embodiment of the invention.

Referring to FIG. 4, a second embodiment is described hereinafter.

The inclined surface 67 is formed on all the surface of the left end portion in the rotor 15.

In this connection, by forming the inclined surface 110 having an angle θ on all the surface of the left end portion of the rotor 15, even when the rotor 15 is more largely inclined or even when the thermal expansion of the rotor chamber 33 is more large, or in the case that the bearings 71, 73, 75 and 77 generate a periodical fretting abrasion and the gap between the respective inner and outer races and the ball is increased, an effect of preventing the contact with the rotor chamber 33 can be obtained, and the peeling of the coating can be prevented.

In this case, the inclined surfaces having the angles θ and θ' may be formed on the right end portion of the rotor 15 and the left end portion of the rotor 17.

Moreover, in accordance with the present invention, the inclined surface of the rotor end portion is not limited to the planner surface, that is, the linear inclined surface forming the angle θ, may be a curved surface, that is, an inclined surface having a curvature such that the angle θ continuously changes to a diametrical direction.

Further, the two-shaft fluid machine in accordance with the present invention is not limited to the compressor and the blower, and may be employed as a motor for applying a fluid pressure so as to take out a rotation.

Figure 3:
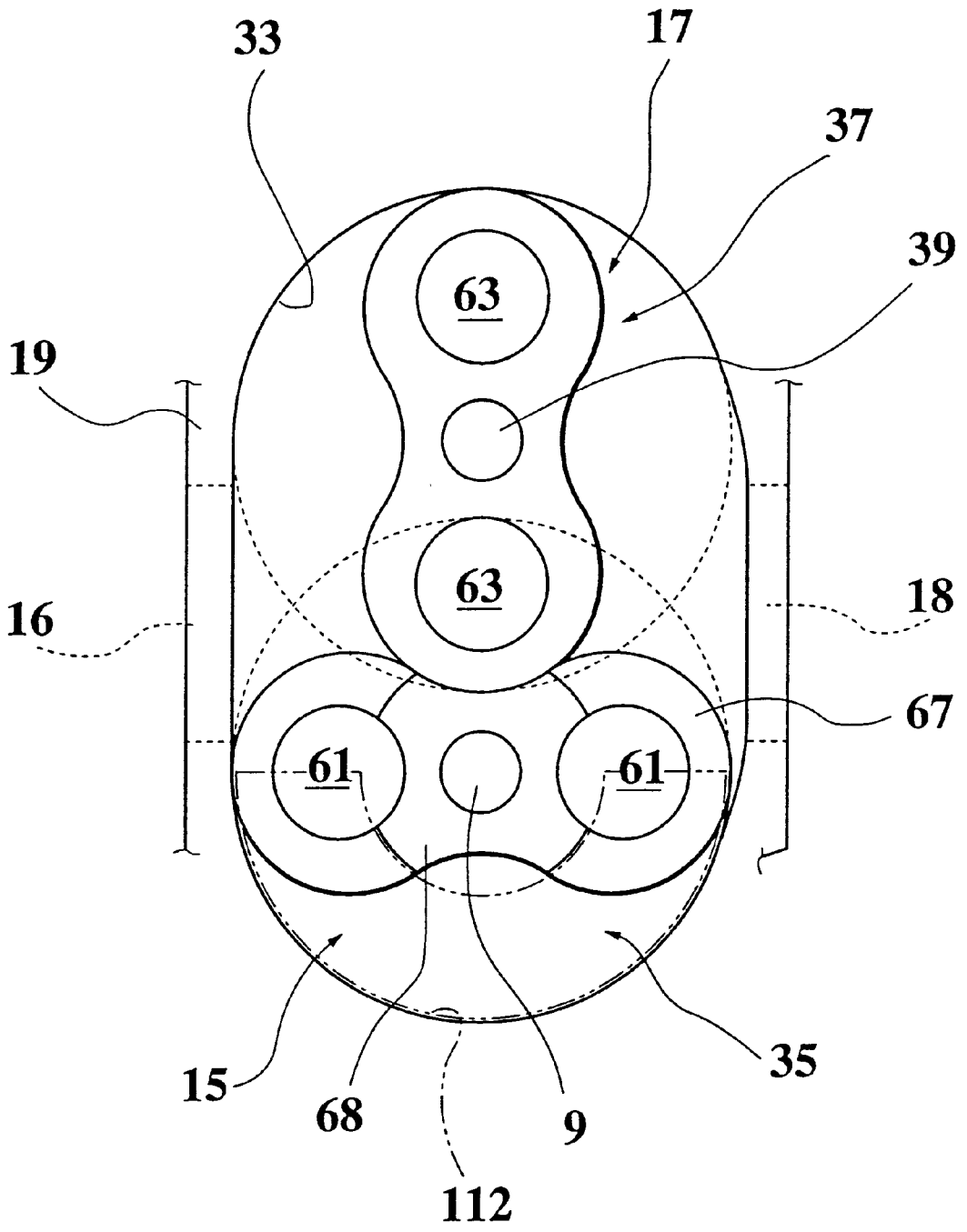
FIG. 3 is a side elevational view of a rotor along a III—III cross section in FIG. 2.

For example, as shown in FIGS. 2 and 3 as two dotted line, the opposing surface 112 can be formed in such a manner that the opposing surface 112 is inclined to gain the clearance and the gap between the left(in FIG. 2) end surface of the rotor body 35 and the inclined opposing surface 112. In this construction, even when a tension of the belt is applied to the rotor shaft 9 of the input end rotor 15 through the pulley 3 in one direction as shown in an arrow A of FIG. 2 and the rotor 15 (the rotor shaft 9) is inclined, the left(in FIG. 2) end surface of the rotor body 35 and the inclined opposing surface 112 are prevented to contact and jam each other depending upon the clearance and the gap. In those cases, the construction where the inclined surface 67 is inclined, is more effectively than the construction where the opposing surface 112 is inclined, on the results of keeping the clearance and the gap and of machine-working on the inclined surfaces.

Furthermore, the two-shaft fluid machine in accordance with the present invention is not limited to the roots displacement fluid machine, and also includes a fluid machine which is composed of rotors having plural screw-shaped protruding teeth and the like.

While preferred embodiments of the present invention have been described using specific terms, such description is for illustrative purposes, and it is to be understood that changes and variations may be made without departing from the spirit or scope of the following claims.

What is claimed is:

1. A two-shaft fluid machine comprising:

a pair of rotors meshed with each other in a tooth trace formed at an outer peripheral end of a rotating central axis; and a casing having a rotor chamber rotatably receiving each of the rotors, a fluid inlet port for a fluid and a fluid outlet port, wherein an inclined surface forming an angle θ with respect to an opposing surface of the rotor chamber is disposed at least in a tip end of the rotor end portion, thereby forming a gap with respect to the opposing surface and wherein the rotor includes a plane surface opposite the inner surface of the rotor chamber at the center portion of the rotor end portion.

2. The two-shaft fluid machine according to claim 1, wherein the rotor further comprises an inclined surface having an angle θ at the outer portion of the rotor end portion.

3. The two-shaft fluid machine according to claim 1, further comprising:

a transmission mechanism for transmitting a rotation drive force to the rotor in the input end, wherein the rotation drive force generates an inclination of the rotor and wherein the angle θ of the inclined surface is based on said inclination of the rotor.

4. The two-shaft fluid machine according to claim 1, wherein the two-shaft fluid machine is a roots displacement fluid machine of which the pair of rotors meshes with each other in the tooth traces formed in parallel to a rotating central axis of the rotors.

* * * * *